US010260187B2

(12) United States Patent
Sakai

(10) Patent No.: US 10,260,187 B2
(45) Date of Patent: Apr. 16, 2019

(54) FOOT CONTROLLER OF SEWING MACHINE

(71) Applicant: JANOME SEWING MACHINE Co., Ltd., Hachioji-shi, Tokyo (JP)

(72) Inventor: Yoshihiro Sakai, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 9 days.

(21) Appl. No.: 15/801,176

(22) Filed: Nov. 1, 2017

(65) Prior Publication Data

US 2018/0163331 A1 Jun. 14, 2018

(30) Foreign Application Priority Data

Dec. 13, 2016 (JP) ..... 2016-241118

(51) Int. Cl.

| | |
|---|---|
| ***D05B 69/18*** | (2006.01) |
| ***G05G 1/32*** | (2008.04) |
| ***G05G 1/44*** | (2008.04) |

(52) U.S. Cl.

CPC ..... *D05B 69/18* (2013.01); *G05G 1/32* (2013.01); *G05G 1/44* (2013.01); *D05D 2205/04* (2013.01)

(58) Field of Classification Search

CPC ..... D05B 69/18; H01H 21/26; H02P 7/00; H01C 10/00; D06D 2205/04

USPC ..... D15/72

See application file for complete search history.

(56) References Cited

U.S. PATENT DOCUMENTS 3,170,425 A * 2/1965 Becker ..... D05B 69/22 112/220
3,821,534 A * 6/1974 Mehner et al. ..... H01H 13/562 200/302.2
4,397,251 A * 8/1983 Leutwyler ..... B65H 75/42 112/277

(Continued)

FOREIGN PATENT DOCUMENTS

DE 1563752 A1 4/1970
DE 3335652 A1 5/1984

(Continued)

OTHER PUBLICATIONS

Extended European Search Report dated Mar. 20, 2018, in corresponding European Patent Application No. 17199245.6.

*Primary Examiner* — Ismael Izaguirre
(74) *Attorney, Agent, or Firm* — McGinn IP Law Group, PLLC.

(57) ABSTRACT

A foot controller includes: a pedal portion that is to be depressed by a foot thereon; a pedal stand on which one end of the pedal portion is supported so that the pedal portion freely pivots about a pivot portion; a speed control member that controls an operation speed of a sewing machine; and a depression suppression member that regulates and controls a depressing operation of the pedal portion in accordance with the depression speed of the pedal portion. In response to a depressing operation which does not involve an abrupt speed change of the pedal portion, the depression suppression member is not operated and the operation speed of the sewing machine is controlled according to an amount of depression of the pedal portion. In response to a depressing operation which involves an abrupt speed change of the pedal portion, the depression suppression member is operated.

7 Claims, 4 Drawing Sheets

(56) References Cited

U.S. PATENT DOCUMENTS

| | | | | | |
|---|---|---|---|---|---|
| 4,473,020 | A * | 9/1984 | Neki | H02P 29/0016 | 112/277 |
| 4,543,850 | A * | 10/1985 | Bednar | B60K 26/00 | 180/335 |
| 4,586,448 | A | 5/1986 | Lerch et al. | | |
| 5,208,520 | A | 5/1993 | Sawato et al. | | |
| 5,233,278 | A * | 8/1993 | Carter | D05B 69/18 | 112/217.4 |
| 5,321,383 | A * | 6/1994 | Colange | G05G 1/38 | 112/217.4 |
| 6,474,753 | B1 * | 11/2002 | Rieth | G05G 1/38 | 180/271 |
| 6,931,962 | B2 * | 8/2005 | Maurer | G05G 1/30 | 74/491 |
| 2012/0031220 | A1 * | 2/2012 | Seki | B60R 21/09 | 74/512 |
| 2015/0206675 | A1 * | 7/2015 | Modi | G06F 3/02 | 307/119 |

FOREIGN PATENT DOCUMENTS

| | | | |
|---|---|---|---|
| DE | 4028256 | C1 | 9/1991 |
| DE | 4241446 | C1 | 10/1993 |
| EP | 2524988 | A1 | 11/2012 |
| JP | H05-11256 | U | 2/1993 |
| JP | 2006-020664 | A | 1/2006 |

* cited by examiner

Fig. 1A
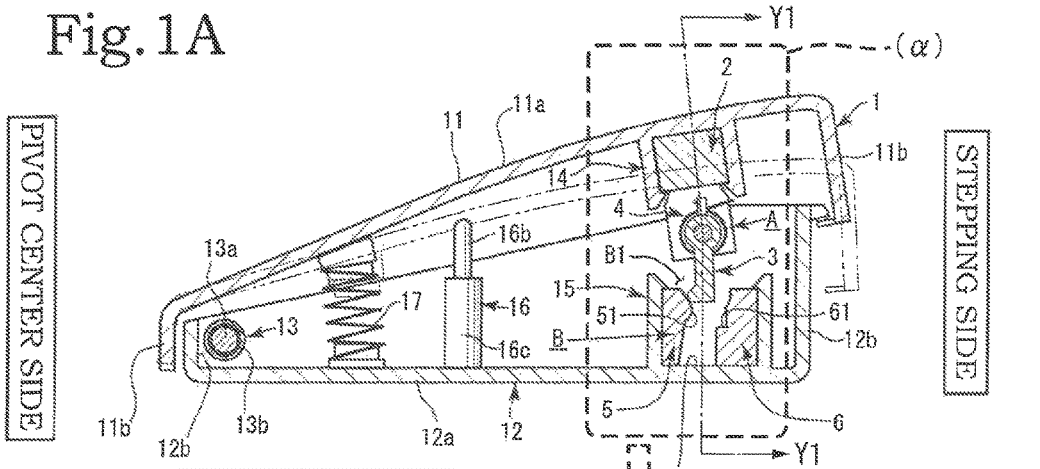
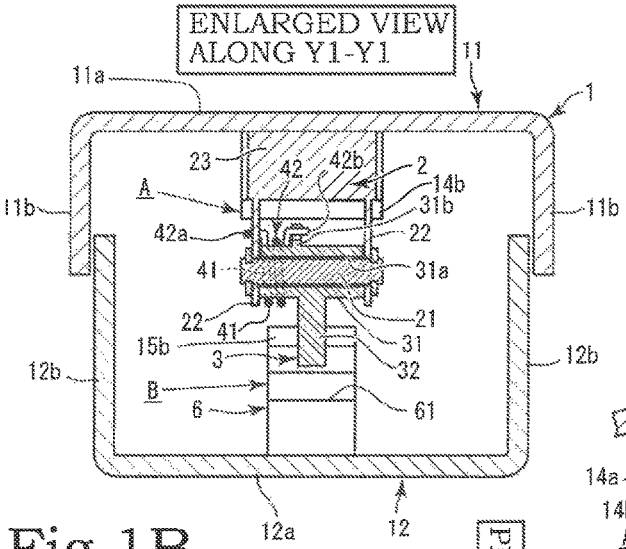
Fig. 1B
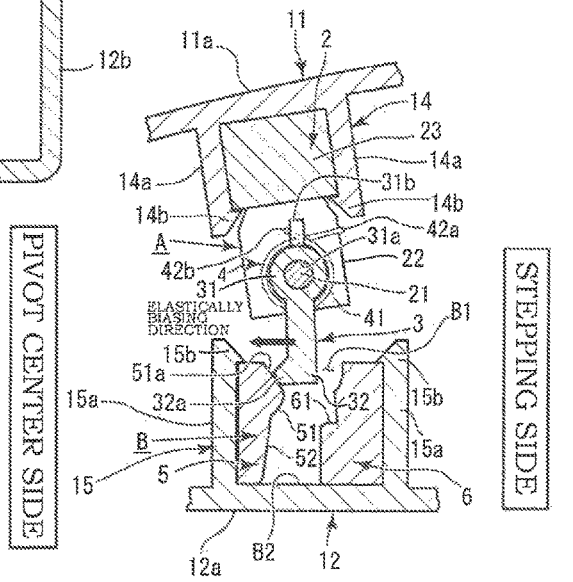
Fig. 1C

NORMAL DEPRESSION

LOW-SPEED (NORMAL) DEPRESSION

ABRUPT DEPRESSION

PIVOT CENTER SIDE
STEPPING SIDE
HIGH-SPEED (ABRUPT) DEPRESSION
1
2
3
5
6
11
11a
11b
12
12a
12b
13
13a
13b
14
15
16
16b
16c
17
51
51a
61
32a
A
B
B1
B2

ENLARGED VIEW OF (β)-PART

FOOT CONTROLLER OF SEWING MACHINE

BACKGROUND OF THE INVENTION

1. Field of the Invention

The present invention relates to a foot controller of a sewing machine capable of preventing abrupt starting of the sewing machine when the foot controller to be used in a sewing operation is abruptly depressed due to an operation error, whereby safety thereof is ensured.

2. Description of the Related Art

Household sewing machines which generally have a foot controller so that a sewing operation can be performed comfortably have been used widespread. A foot controller is a very convenient tool with which operations can be performed comfortably. However, there is a sufficient possibility that users erroneously operates the foot controller carelessly to abruptly depress a pedal portion of the foot controller. In such a case, the sewing machine starts suddenly and a needle bar having a needle attached to a distal end thereof starts moving vertically, which is very dangerous to users.

SUMMARY OF THE INVENTION

Japanese Patent Application Publication No. 2006-20664 filed by the present applicant discloses an invention capable of securing safety by satisfactorily taking measures against an operation error due to, for example, an unintended and abrupt depressing the foot controller by users. The invention disclosed in Japanese Patent Application Publication No. 2006-20664 secures safety with the aid of electric means.

However, the technique of Japanese Patent Application Publication No. 2006-20664 is generally employed in high-end sewing machines and is not employed in low-cost sewing machines. Due to this, there is a demand for a foot controller capable of securing and providing a safety mechanism for preventing abrupt starting of a sewing machine using the foot controller in the event of an operation error such as abrupt depression of the foot controller in a simple configuration and at a very low cost.

Therefore, an object (a problem to be solved) of the present invention is to provide a foot controller of a sewing machine capable of preventing abrupt starting of the sewing machine having the foot controller due to, for example, an unintended operation error of users and realizing a safety securing mechanism in a simple configuration and at a very low cost.

As a result of intensive studies to solve the above problems, the present inventor solved the problems by providing, as a first embodiment of the present invention, a foot controller of a sewing machine, including: a pedal portion that is to be depressed by a foot thereon; a pedal stand on which one end of the pedal portion is supported so that the pedal portion freely pivots about a pivot portion; and a speed control member that controls an operation speed of the sewing machine, the controller further including a depression suppression member that regulates and controls a depressing operation of the pedal portion in according with depression speed of the pedal portion, wherein in response to a depressing operation which does not involve an abrupt speed change of the pedal portion, the depression suppression member is not operated and the operation speed of the sewing machine is controlled according to an amount of depression of the pedal portion, and in response to a depressing operation which involves an abrupt speed change of the pedal portion, the depression suppression member is operated to regulate the depressing operation of the pedal portion.

A second embodiment of the present invention solves the problems by providing a foot controller of a sewing machine, including: a pedal portion that is to be depressed by a foot thereon; a pedal stand on which one end of the pedal portion is supported so that the pedal portion freely pivots about a pivot portion; and a speed control member that controls an operation speed of the sewing machine, the foot controller further including a depression suppression block that includes a depression suppression arm suppressing a depressing operation of the pedal portion; and a depressed block that includes a depression guide portion and a stopper portion, the depression guide portion having a projection-shaped guiding surface for guiding the depression suppression arm, and the stopper portion having a locking portion disposed to be separated by a predetermined distance on an extension line of the projection-shaped guiding surface of the depression guide portion so as to lock a distal end of the depression suppression arm, wherein the depression suppression arm of the depression suppression block is always in contact with the depression guide portion, when the pedal portion performs a depressing operation which involves an abrupt speed change, the distal end of the depression suppression arm is separated from the depression guide portion and is locked to the locking portion of the stopper portion.

A third embodiment of the present invention solves the problems by providing the foot controller of the sewing machine according to the second embodiment, in which the depression suppression block is provided in the pedal portion and the depressed block is provided in the pedal stand. A fourth embodiment of the present invention solves the problems by providing the foot controller of the sewing machine according to the second or third embodiment, in which the depression suppression arm is elastically biased so as to make contact with the depression guide portion. A fifth embodiment of the present invention solves the problems by providing the foot controller of the sewing machine according to the first or second embodiment, in which the depression suppression arm is elastically biased by a spring.

In the present invention and the second embodiment of the present invention, the depressed block in the controller body includes the depression guide portion and the stopper portion. The depression suppression arm of the depression suppression block is elastically biased in the direction of always making contact with the depression guide portion. The depression guide portion is positioned closer to the pivot portion than the stopper portion, and the projection-shaped guiding surface of the depression guide portion faces the locking portion of the stopper portion. Moreover, the locking portion of the stopper portion is positioned closer to the bottom portion than the projection-shaped guiding surface of the depression guide portion.

Due to this, in a state (that is, a slow depression state) in which the user of the sewing machine depresses the pedal portion of the controller body at a normal depression speed, the depression suppression arm is elastically biased toward the guiding surface of the depression guide portion, and the distal end of the depression suppression arm is moved from the inlet portion of the depression suppression block toward the bottom portion in a contacting state. In this process, the pedal portion presses the speed control member for controlling the operation speed of the sewing machine included in the controller body and the sewing machine can be started. In this case, since the sewing machine starts slowly according to the slow depression speed of the pedal portion, the user can operate the sewing machine safely.

The user may erroneously depress the pedal portion abruptly and the sewing machine may start abruptly to fall into a dangerous state. However, in such a case, the depression suppression arm of the depression suppression block moves at a high speed abruptly and is separated from the projection-shaped guiding surface exceeding the elastic biasing force. The distal end of the depression suppression arm separated from the projection-shaped guiding surface is locked to the locking portion of the stopper portion facing the depression guide portion, whereby the pivoting of the pedal portion is prevented. Due to this, the depressing operation of the pedal portion is regulated so that the speed control member cannot be operated, and the sewing machine cannot be started. As a result, it is possible to secure safety even when the user depresses the pedal portion at an abrupt depression speed erroneously.

BRIEF DESCRIPTION OF THE DRAWINGS

FIG. 1A is a longitudinal side view of a first embodiment of the present invention, FIG. 1B is an enlarged cross-sectional view along arrow Y1-Y1 in FIG. 1A, and FIG. 1C is an enlarged view of (α)-part in FIG. 1A;

DESCRIPTION OF THE PREFERRED EMBODIMENTS

Figure 2A:
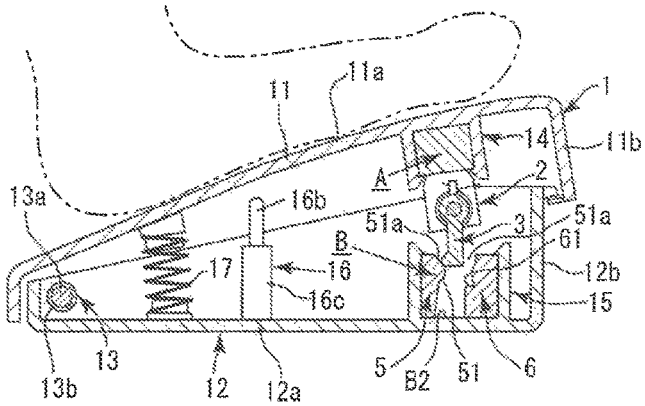
FIGS. 2A to 2D are cycle diagrams illustrating operations of a depressed block and a depression suppression arm of a depression suppression block in a normal depression state according to the first embodiment of the present invention.
Figure 2B:
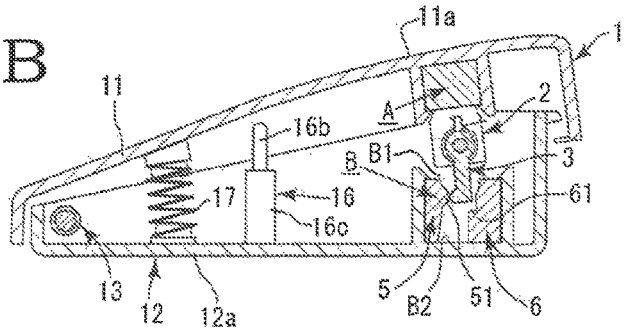
Figure 2C:
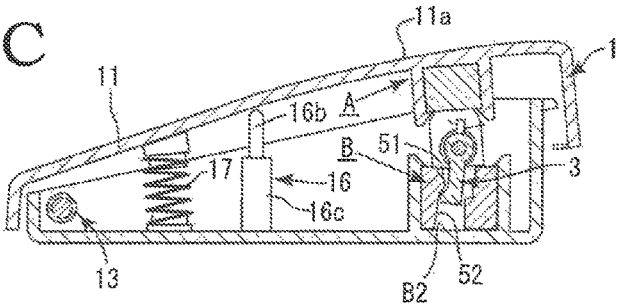
Figure 2D:
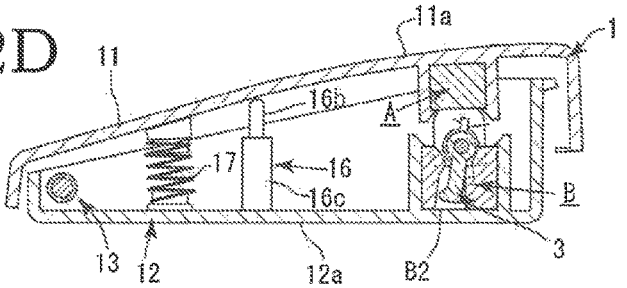

Hereinafter, embodiments of the present invention will be described with reference to the drawings. A foot controller of the present invention mainly includes a controller body 1 and a depression suppression member. The depression suppression member includes a depression suppression block A and a depressed block B (see FIGS. 1A to 1C). The controller body 1 includes a pedal portion 11, a pedal stand 12, and a pivot portion 13 (see FIG. 1A). The depressed block B that forms the depression suppression member includes a depression guide portion 5 and a stopper portion 6.

The pedal portion 11 is configured to pivot about the pivot portion 13 in relation to the pedal stand 12 (see FIGS. 2A to 2D). The pedal portion 11 has approximately suspension-like, curtain-shaped lateral portions 11*b* formed around an approximately rectangular stepping surface 11*a*. The pedal stand 12 has rising lateral portions 12*b* formed around an approximately rectangular bottom surface 12*a*. The pivot portion 13 is provided at a position close to one end in a longitudinal direction of the pedal portion 11 and the pedal stand 12 (see FIG. 1A).

The pivot portion 13 includes shaft members 13*a* such as a pin and a shaft, and a bearing member 13*b* that supports these shaft members 13*a*. The shaft members 13*a* and the bearing member 13*b* are provided in the pedal portion 11 and the pedal stand 12, and the pedal portion 11 freely pivots about the pivot portion 13. In the controller body 1, a side in the longitudinal direction on which the pivot portion 13 is provided will be referred to as a pivot center side and a side opposite to the side on which the pivot portion 13 is provided will be referred to as a stepping side (see FIG. 1A).

A depression spring 17 and a speed control member 16 are assembled between the pedal stand 12 and the pedal portion 11 of the controller body 1 (see FIG. 1A). Usually, the stepping surface 11*a* of the pedal portion 11 of the controller body 1 is in an inclined state, when the pedal portion is not used, and is positioned farthest from the pedal stand 12 on the stepping side opposite to the pivot center side on which the pivot portion 13 is positioned.

The depression spring 17 is a compression coil spring and acts in a direction in which the pedal portion 11 and the pedal stand 12 are always separated from each other on the stepping side. The depression spring 17 is contracted when a user depresses the pedal portion 11, and the rear surface of the stepping surface 11*a* of the pedal portion 11 activates the speed control member 16. When a depressing operation on the pedal portion 11 which has been depressed is released, the depression spring 17 performs a role of returning the pedal portion 11 to an original position.

The speed control member 16 performs a role of controlling an operation speed of the sewing machine. Specifically, a variable resistor-type speed control member is used. Specifically, as illustrated in FIG. 1A, the speed control member 16 includes a housing portion 16*a* and a telescopic portion 16*b*. The housing portion 16*a* is attached to the pedal stand 12, and the telescopic portion 16*b* is configured to come into contact with the rear surface of the stepping surface 11*a* of the pedal portion 11. The telescopic portion 16*b* is configured to maintain an always protruding state with the aid of an elastic member such as a spring in relation to the housing portion 16*a*.

When a depressing operation is performed, the pedal portion 11 pivots, the rear surface of the stepping surface 11*a* of the pedal portion 11 comes into contact with the telescopic portion 16*b* of the speed control member 16, and the telescopic portion 16*b* is pushed into the housing portion 16*a*. A variable resistor is provided in the housing portion 16*a* and a voltage changes according to the amount of protrusion of the telescopic portion 16*b*. The speed of the sewing machine increases gradually as the telescopic portion 16*b* is pushed into the housing portion 16*a* by the pedal portion 11 (see FIGS. 2A to 2D).

Next, the depression suppression member will be described. The depression suppression member performs a role of regulating and controlling a depressing operation of the pedal portion 11 according to the depression speed of the pedal portion 11. The depression suppression member does not operate in a normal depressing operation of the pedal portion 11 and enables the operation speed of the sewing machine to be controlled according to the amount of depression of the pedal portion 11. Moreover, the depression suppression member operates in a depressing operation which involves an abrupt change is speed of the pedal portion 11 to regulate the depressing operation of the pedal portion. The depression suppression member includes the depression suppression block A and the depressed block B (see FIGS. 1A to 1C).

The depression suppression block A of the depression suppression member includes a base portion 2, a depression suppression arm 3, and a spring 4 (see FIGS. 1B, 1C, etc.).

The configuration of the depression suppression block A will be described in detail. The base portion 2 is formed of a shaft 21, support plates 22, and an attachment portion 23. Both axial ends of the shaft 21 are supported by the support plates 22. Since the base portion 2 is attached to the controller body 1, the block-shaped attachment portion 23 in which the support plates 22 are integrally formed is formed (see FIG. 1A).

In the following description, as a first embodiment of the present invention, it will be described that the depression suppression block A is attached to the pedal portion 11 and the depressed block B is provided on the pedal stand 12. The attachment portion 23 is formed in an approximately rectangular form and is attached to an attaching portion 14 provided in the pedal portion 11 or the pedal stand 12 of the controller body 1. In the first embodiment, the attachment portion 23 is attached to the pedal portion 11 (see FIGS. 1A to 1C).

The attaching portion 14 of the depression suppression block A has two pinching pieces 14*a* which fix and pinch the attachment portion 23. Claw pieces 14*b* are formed on the distal ends of both pinching pieces 14*a*, and the base portion 2 is fixedly supported by the controller body 1 by both claw pieces 14*b* (see FIG. 1C).

The depression suppression arm 3 is formed of a swing center portion 31 and a swing arm 32 (see FIGS. 1A to 1C). The shaft 21 is inserted into a shaft hole 31*a* of the swing center portion 31, and the swing arm 32 of the depression suppression arm 3 freely swings about the shaft 21 (see FIGS. 1B and 1C). The swing direction of the depression suppression arm 3 is the circumferential direction of the shaft 21. The depression suppression arm 3 is elastically biased in the direction of coming into contact with the depression guide portion 5.

The spring 4 is used as means for elastic biasing. A torsion spring is used as the spring 4 (see FIGS. 1B and 1C). When the spring 4 is a torsion spring, the swing center portion 31 is inserted into a coil-shaped portion 41, one spring end 42*a* is locked to the support plate 22, and the other spring end 42*b* is locked to a projection portion 31*b* formed on the swing center portion 31 (see FIGS. 1B and 1C).

The depressed block B of the depression suppression member is formed of the depression guide portion 5 and the stopper portion 6 (see FIGS. 1A to 1C). The depression guide portion 5 has a projection-shaped guiding surface 51 and an insertion guiding surface 52. The projection-shaped guiding surface 51 and the insertion guiding surface 52 are continuously formed. The projection-shaped guiding surface 51 and the insertion guiding surface 52 allow the swing arm 32 of the depression suppression arm 3 to be guided and moved along the projection-shaped guiding surface 51 and the insertion guiding surface 52 so that the distal end 32*a* of the swing arm 32 makes contact with the surfaces by the action of the spring 4 (see FIG. 1C).

The depressed block B has an inlet portion B1 in which the depression suppression arm 3 of the depression suppression block A is inserted and a bottom portion B2 that is the deepest position in relation to the inlet portion B1 (see FIGS. 1A and 1C). The projection-shaped guiding surface 51 of the depression guide portion 5 has an inclined guiding surface 51*a* that protrudes toward the stepping side from inlet portion B1 of the depressed block B to the bottom portion B2 (see FIG. 1C). The insertion guiding surface 52 is formed so as to be recessed from an end close to the bottom portion B2 of the inclined guiding surface 51*a* toward the pivot center (the pivot portion). The insertion guiding surface 52 is inclined so as to approach the pivot portion 13 as it advances from the inlet portion B1 to the bottom portion B2.

The stopper portion 6 faces the depression guide portion 5 and is provided to be positioned closer to the stepping side of the controller body 1 than the depression guide portion 5 (see FIG. 1C). A locking portion 61 is formed in an intermediate portion in a vertical direction of the stopper portion 6 on a surface (the surface close to the pivot center side) facing the depression guide portion 5. The locking portion 61 is formed as an approximately horizontal end (see FIG. 1C). However, the shape of the end of the locking portion 61 is not limited to this.

Obviously the end of the locking portion 61 has an arbitrary locking shape following the distal end shape of the swing arm 32. The locking portion 61 is provided on an extension line in the direction in which the swing arm 32 slides on the projection-shaped guiding surface 51 (see FIG. 1C and FIGS. 3A to 3D). A smallest gap between the facing surfaces of the depression guide portion 5 and the stopper portion 6 may be set such that the depression suppression arm 3 can pass through the smallest gap (see FIG. 1C).

The depression guide portion 5 and the stopper portion 6 of the depressed block B are attached to the pedal stand 12 of the controller body 1. An attaching portion 15 of the depressed block B has two pinching pieces 15*a* which fix and pinch the attachment portion 23 similarly to the depression suppression block A (see FIG. 1C). Claw pieces 15*b* are formed on the distal ends of both pinching pieces 15*a*, and the base portion 2 is fixedly supported by the controller body 1 by both claw pieces 15*b*. Attachment means is not limited to the pinching pieces 15*a* disclosed herein.

Next, the operation of the present invention will be described with reference to FIGS. 2A to 2D and FIGS. 3A to 3D. As described above, in the foot controller of the sewing machine according to the present invention, when a user steps on the stepping surface 11*a* to depress the pedal portion 11 by a predetermined amount or more, the rear surface of the pedal portion 11 comes into contact with the speed control member 16 in the controller body 1, and the voltage of the variable resistor (not illustrated) provided therein changes according to the amount of depression of the pedal portion 11.

The sewing machine is operated to perform a sewing operation while changing the speed of the sewing machine according to the change in the voltage. When the foot is separated from the pedal portion 11, the pedal portion 11 returns to the original position, the rear surface of the pedal portion 11 is separated from the speed control member 16 in the controller body 1, the variable resistor provided therein returns to its original position, and the voltage of the variable resistor decreases up to a value at which the sewing machine does not operate, whereby the sewing machine stops. As a result, the sewing machine stops.

First, an operation when a user depresses the pedal portion 11 at a normal depression speed will be described (see FIGS. 2A to 2D). When the pedal portion 11 is depressed, the pedal portion 11 pivots about the pivot portion 13 and swings vertically from a state in which the pedal portion 11 is in contact with the telescopic portion 16*b* of the speed control member 16. In this way, the operation speed of the sewing machine can be controlled on the basis of a change in the voltage of the variable resistor provided therein according to the amount of depression of the pedal portion 11. Moreover, in a state in which the pedal portion 11 is not depressed (that is, the pedal portion 11 is not operated), the pedal portion 11 and the telescopic portion 16*b* of the speed control member 16 are separated from each other.

The depression suppression arm 3 of the depression suppression block A in the controller body 1 is in contact with the projection-shaped guiding surface 51 of the depression guide portion 5 of the depressed block B with an elastic biasing force of the spring 4. When the pedal portion 11 of the controller body 1 is depressed at a normal depression speed which does not involve an abrupt speed change, the depression suppression arm 3 moves from the inlet portion B1 of the depressed block B toward the bottom portion B2 along the projection-shaped guiding surface 51 and the insertion guiding surface 52 of the depression guide portion 5.

In this case, since the depression speed of the normal depressing operation of the user does not involve an abrupt speed change, the depression suppression arm 3 can maintain the state of being in contact with the projection-shaped guiding surface 51 and the insertion guiding surface 52 with the elastic biasing force of the spring 4 during the operation. Even after the pedal portion 11 is lowered to some extent, the depressed pedal portion 11 makes contact with the telescopic portion 16*b* of the speed control member 16 and is pushed into the housing portion 16*a* to operate the sewing machine on the basis of the change in the voltage of the variable resistor provided therein according to the amount of pushing. In this way, in a normal operation which does not involve an abrupt speed change, the sewing machine starts safely and the operation speed can be varied smoothly.

Next, the operation of the depression suppression block A and the depressed block B when a user performs a depressing operation which involves an abrupt speed change such as unintended and erroneous depression of the pedal portion 11 or an object falling on the pedal portion 11 will be described. When the user of the sewing machine erroneously depresses the pedal portion 11 with an abrupt speed change, the distal end 32*a* of the swing arm 32 of the depression suppression arm 3 swiftly slides on the inclined guiding surface 51*a* of the projection-shaped guiding surface 51. Moreover, the distal end 32*a* of the swing arm 32 moves along the inclination direction of the inclined guiding surface 51*a* with the depression speed of the pedal portion 11 (see FIG. 3A).

Figures 3A, 3B, 3C, 3D:
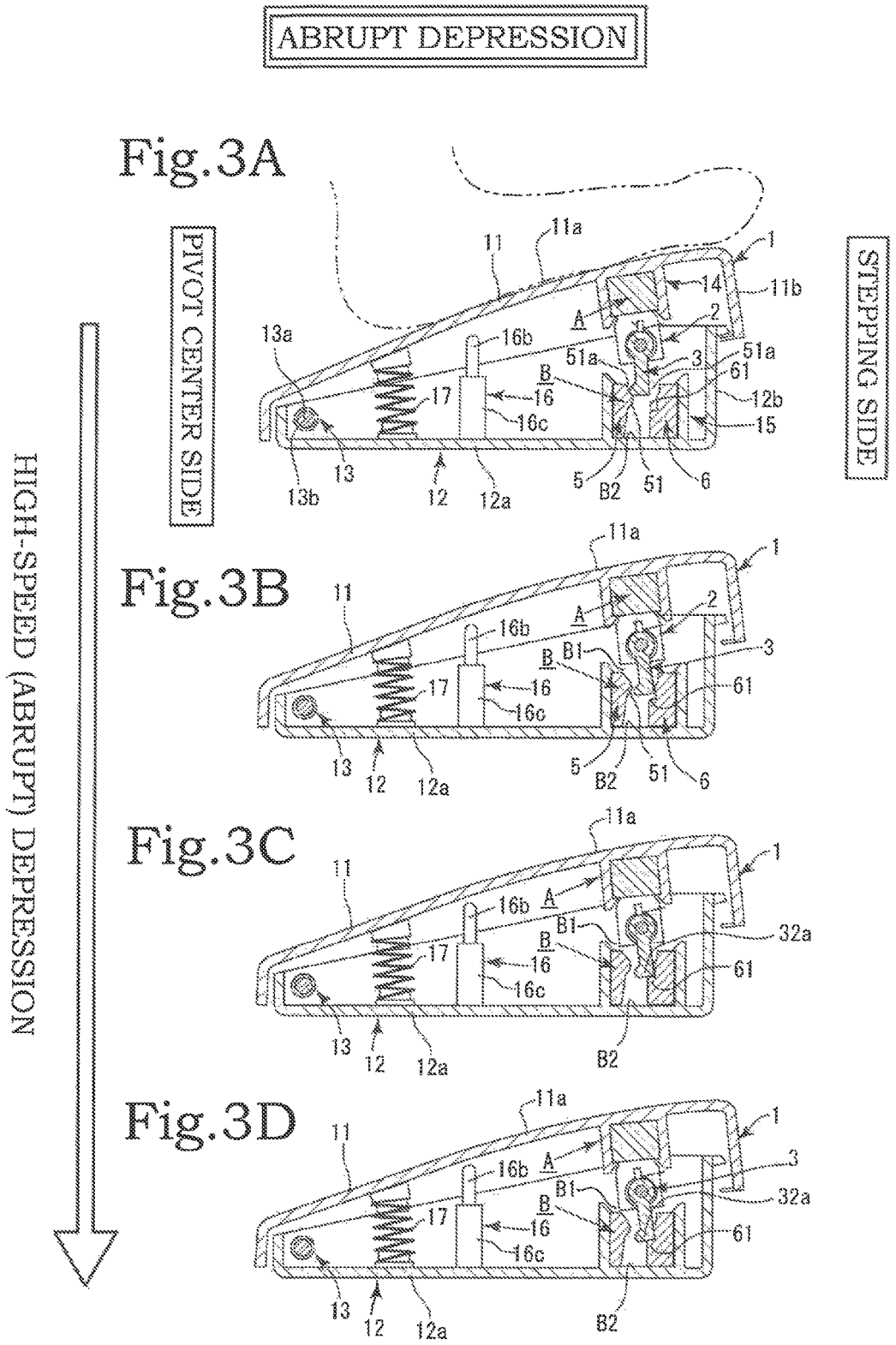
FIGS. 3A to 3D are cycle diagrams illustrating operations of a depressed block and a depression suppression arm of a depression suppression block in an abrupt depression state according to the first embodiment of the present invention.

The moving speed of the distal end 32*a* exceeds the pivot speed of the swing arm 32 of the depression suppression arm 3 by the elastic biasing force of the spring 4 that presses the distal end of the depression suppression arm 3 against the projection-shaped guiding surface 51 and the distal end 32*a* of the depression suppression arm 3 is separated from the projection-shaped guiding surface 51 (see FIG. 3B). The distal end 32*a* of the depression suppression arm 3 separated from the projection-shaped guiding surface 51 is locked to the locking portion 61 of the stopper portion 6 facing the depression guide portion 5 (see FIG. 3C).

In this way, the pedal portion 11 is regulated not to pivot downward (see FIG. 3D). Therefore, the pedal portion 11 is unable to pivot and does not operate and a state in which the speed control member 16 cannot be operated is created. Therefore, even when the user erroneously depresses the pedal portion 11 at an abrupt depression speed, the user cannot start the sewing machine and the safety of the user can be secured.

As described above, when an abrupt depressing operation of the pedal portion 11 is performed, the depression suppression block A and the depressed block B are operated so that the distal end of the depression suppression arm 3 comes into contact with the locking portion 61 of the depressed block B to stop pivoting of the pedal portion 11. Therefore, the rear surface of the pedal portion 11 and the telescopic portion 16*b* of the speed control member 16 do not make contact with each other until the pedal portion 11 moves to a position at which the distal end of the depression suppression arm 3 makes contact with and locks the locking portion 61 of the depressed block B.

That is, a pivot angle of the pedal portion 11 until the rear surface of the pedal portion 11 makes contact with the distal end of the telescopic portion 16*b* of the speed control member 16 is larger than a pivot angle of the pedal portion 11 until the depression suppression arm 3 of the depression suppression block A makes contact with and locks the locking portion 61 of the depressed block B. When the depression suppression block A and the depressed block B are operated according to an abrupt depressing operation, the distal end 32*a* of the depression suppression arm 3 comes into contact with and locks the locking portion 61 before the pedal portion 11 operates the speed control member 16.

Figure 4A:
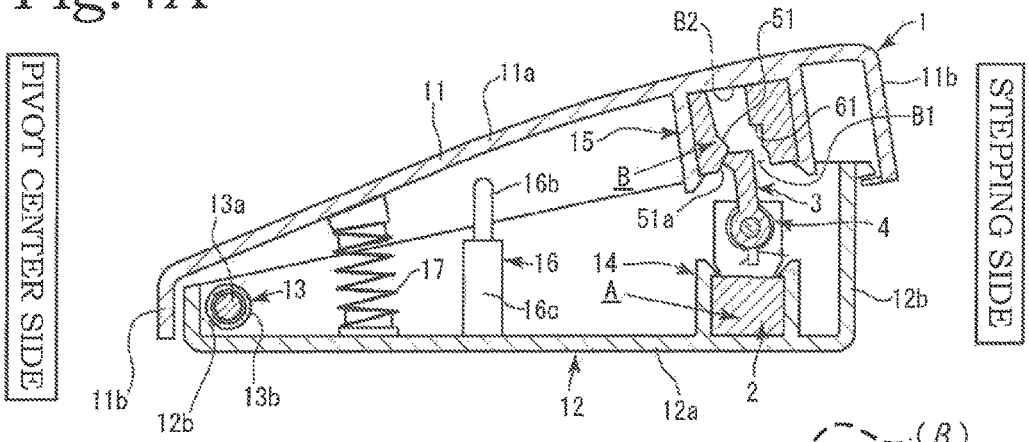
FIG. 4A is a longitudinal side view of a second embodiment of the present invention.

In a second embodiment of the present invention, the depression suppression block A is attached to the pedal stand 12 and the depressed block B is attached to the pedal portion 11 (see FIG. 4A). That is, the depression suppression block A is attached to the attaching portion 14 formed on the pedal stand 12 and the depressed block B is attached to the attaching portion 15 formed on the pedal portion 11. In the second embodiment, the vertical direction of the depressed block B is reverse to that of the first embodiment. Therefore, an inlet of the depressed block B is positioned on the lower side and the bottom thereof is positioned on the upper side.

Figure 4B:
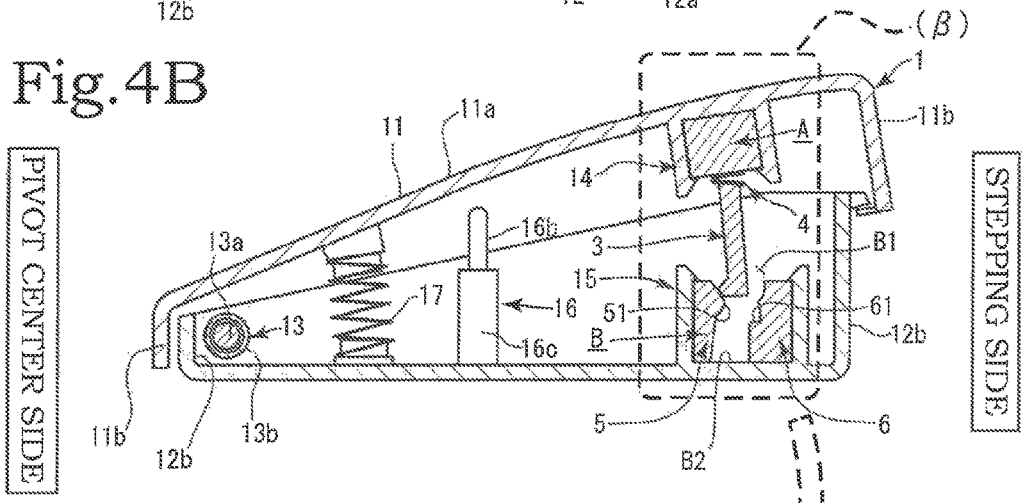
FIG. 4B is a longitudinal side view of a third embodiment of the present invention.
Figure 4C:
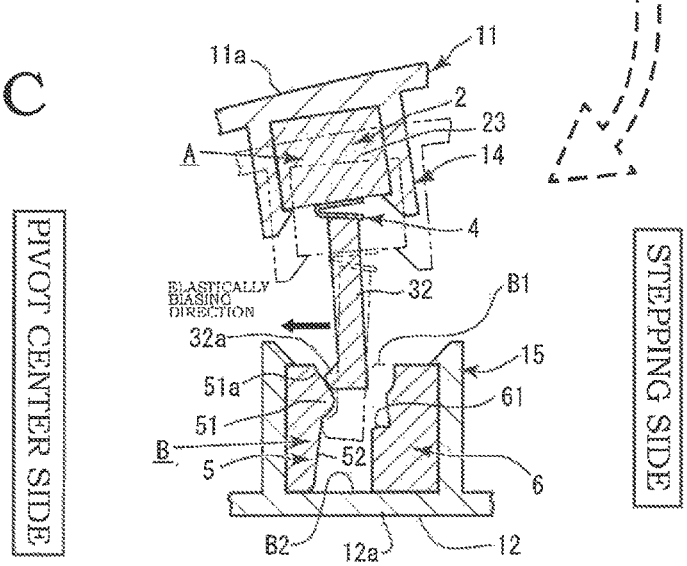
FIG. 4C is an enlarged view of (β)-part in FIG. 4B.

In a third embodiment of the present invention, as illustrated in FIG. 4B, the spring 4 for elastically biasing the depression suppression arm 3 of the depression suppression block A toward the depression guide portion 5 of the depressed block B is configured as a plate spring. In a specific embodiment in which the spring 4 is a plate spring, a sheet metal is folded in an approximately V shape and the base portion 2 and the depression suppression arm 3 are connected by the spring 4. The folded-back portion of the V-shaped spring 4 is provided to face the pivot portion 13 and the depression suppression arm 3 is elastically biased so that the depression suppression arm 3 is always in contact with the depression guide portion 5 (see FIG. 4C).

In the third embodiment, it is possible to have a plurality of assembly patterns of the present invention and to improve the manufacturing efficiency. In the fourth embodiment, the depression suppression arm has elasticity so as to make contact with the depression guide portion. Therefore, it is not necessary to provide a separate spring for generating an elastic biasing force, and it is possible to decrease the number of components, to simplify the structure, and to reduce the cost. In the fifth embodiment, since the depression suppression arm is elastically biased by a torsion spring, it is possible to maintain a stable elastic biasing force for a long period.

What is claimed is:

1. A controller of a sewing machine, comprising:

a pedal portion that is to be depressed by a foot thereon;

a pedal stand on which one end of the pedal portion is supported so that the pedal portion freely pivots about a pivot portion; and a speed control member that controls an operation speed of the sewing machine, the controller further comprising a depression suppression member that regulates and controls a depressing operation of the pedal portion in accordance with depression speed of the pedal portion, wherein in response to a depressing operation which does not involve an abrupt speed change of the pedal portion, the depression suppression member is not operated and the operation speed of the sewing machine is controlled according to an amount of depression of the pedal portion, and in response to a depressing operation which involves an abrupt speed change of the pedal portion, the depression suppression member is operated to regulate the depressing operation of the pedal portion.

2. The foot controller of a sewing machine according to claim 1, wherein the depression suppression arm is elastically biased by a spring.

3. A foot controller of a sewing machine, comprising:

a pedal portion that is to be depressed by a foot thereon;

a pedal stand on which one end of the pedal portion is supported so that the pedal portion freely pivots about a pivot portion; and a speed control member that controls an operation speed of the sewing machine, the foot controller further comprising a depression suppression block that includes a depression suppression arm suppressing a depressing operation of the pedal portion; and a depressed block that includes a depression guide portion and a stopper portion, the depression guide portion having a projection-shaped guiding surface for guiding the depression suppression arm, and the stopper portion having a locking portion disposed to be separated by a predetermined distance on an extension line of the projection-shaped guiding surface of the depression guide portion so as to lock a distal end of the depression suppression arm, wherein the depression suppression arm of the depression suppression block is always in contact with the depression guide portion, when the pedal portion performs a depressing operation which involves an abrupt speed change, the distal end of the depression suppression arm is separated from the depression guide portion and is locked to the locking portion of the stopper portion.

4. The foot controller of a sewing machine according to claim 3, wherein the depression suppression block is provided in the pedal portion and the depressed block is provided in the pedal stand.

5. The foot controller of a sewing machine according to claim 4, wherein the depression suppression arm is elastically biased so as to make contact with the depression guide portion.

6. The foot controller of a sewing machine according to claim 3, wherein the depression suppression arm is elastically biased so as to make contact with the depression guide portion.

7. The foot controller of a sewing machine according to claim 3, wherein the depression suppression arm is elastically biased by a spring.

* * * * *